United States Patent [19]

Sakai et al.

[11] Patent Number: 4,523,448

[45] Date of Patent: Jun. 18, 1985

[54] METHOD AND APPARATUS FOR CONTINUOUSLY PRODUCING A CORE MEMBER OF A TRIM

[75] Inventors: Hiromu Sakai, Aichi; Sazo Ezaki, Bisai; Atsuo Kikuchi, Ichinomiya, all of Japan

[73] Assignee: Toyoda Gosei Co., Ltd., Nishikasugai, Japan

[21] Appl. No.: 540,850

[22] Filed: Oct. 11, 1983

Related U.S. Application Data

[63] Continuation of Ser. No. 495,492, May 17, 1983, abandoned, which is a continuation of Ser. No. 220,716, Dec. 29, 1980, abandoned.

[30] Foreign Application Priority Data

Dec. 27, 1979 [JP] Japan ..... 54-172383

[51] Int. Cl.[3] ..... B21D 31/02

[52] U.S. Cl. ..... 72/185; 72/187; 29/6.1; 29/413; 83/343; 83/345; 83/284

[58] Field of Search ..... 72/184–187, 72/190, 196, 197; 29/157.3 D, 160, 163.5 R, 6.1, 413; 83/302, 343, 345, 284

[56] References Cited

U.S. PATENT DOCUMENTS

| | | | |
|---|---|---|---|
| 1,544,269 | 6/1925 | Naugle et al. | 29/6.1 |
| 2,250,593 | 7/1941 | Mesnel | 72/187 |
| 2,537,026 | 1/1951 | Brugger | 72/187 |
| 2,568,333 | 9/1951 | Henschker et al. | 83/345 |
| 2,764,238 | 9/1956 | Rusinoff et al. | 83/343 |
| 3,293,725 | 12/1966 | Gunter et al. | 29/6.1 |
| 3,322,012 | 5/1967 | Murray | 83/345 |
| 3,431,830 | 3/1969 | Stovall | 83/343 |
| 3,550,246 | 12/1970 | Zoller | 29/6.1 |
| 3,677,120 | 7/1972 | Sieurin | 83/343 |
| 3,985,054 | 10/1976 | Marino | 83/345 |
| 4,333,221 | 6/1982 | Hayashi | 29/413 |
| 4,339,860 | 7/1982 | Hayashi | 29/413 |

FOREIGN PATENT DOCUMENTS

| | | | |
|---|---|---|---|
| 183018 | 11/1966 | U.S.S.R. | 83/343 |

*Primary Examiner*—Lowell A. Larson

*Attorney, Agent, or Firm*—Cushman, Darby & Cushman

[57] ABSTRACT

A method for continuously producing a core member to be embedded within a trim, comprises the continuous steps of forming slits in a band-shaped metallic plate by means of slitting rolls, elongating the slit metallic plate by means of elongating rolls and pressing the elongated metallic plate by means of finishing rolls.

5 Claims, 12 Drawing Figures

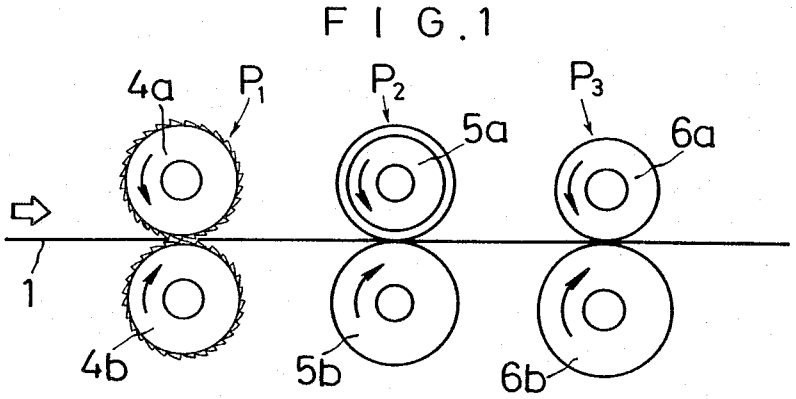
FIG.1
P1
P2
P3
4a
4b
5a
5b
6a
6b
1
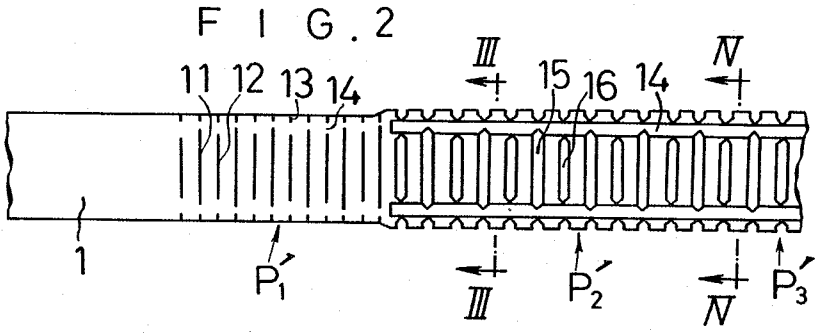
FIG.2
11
12
13
14
15
16
III
IV
P1'
P2'
P3'
1
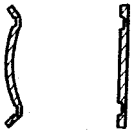
FIG.3
FIG.4
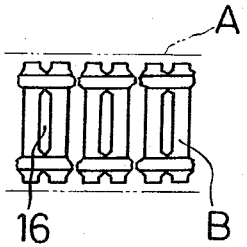
FIG.5
A
B
16

METHOD AND APPARATUS FOR CONTINUOUSLY PRODUCING A CORE MEMBER OF A TRIM

This is a continuation of application Ser. No. 495,492, filed May 17, 1983 which is a continuation of Ser. No. 220,716, filed Dec. 29, 1980, both now abandoned.

BACKGROUND OF THE INVENTION

The present invention relates to a method and apparatus for producing a core member to be embedded within a trim for improving the shape-retentivity thereof.

Conventionally, the core member of the trim is made of a band-shaped metallic thin plate wherein transversely extending long slots are formed at predetermined intervals in the longitudinal direction thereof. And this core member is covered with a covering material such as rubber and synthetic resin. Then, the covered core member is subjected to a bending work in the transverse direction thereof into a desired shape such as a U-shape. The obtained trim is used for protecting or sealing corner portions or joining portions of automobiles and furnitures.

The above described core member of the conventional trim has been produced by punching the long slots by means of a press machine, in general.

However, the punching work has drawbacks that it is troublesome to dispose of produced scraps and that a considerable of material is wasted. And the punching speed is only about 6 m/min. at most, even by a high speed press machine. Thus, the work efficiency is not good.

Accordingly, an object of the present invention is to provide a method and apparatus for producing a core member of a trim, whereby the conventional method can be sped up and the work efficiency is improved.

Another object of the present invention is to provide a method and apparatus for producing a core member of a trim, whereby the material is prevented from being wasted and the material cost can be decreased and slitting rolls are provided with improved durability.

Other objects and advantages of the invention will become apparent from the following description of embodiments with reference to the accompanying drawings wherein:

FIG. 1 is a view explaining a producing process of the present invention;

FIG. 2 is a view showing a band-shaped metallic thin plate which is being worked in the producing process of FIG. 1;

FIG. 3 and FIG. 4 are sectional views taken along the lines of III—III and IV—IV of FIG. 2 respectively;

FIG. 5 is a view showing broken core pieces which are embedded within a covering material;

SUMMARY OF THE INVENTION

According to the method of the present invention, by continuing a slitting process for forming slits in a band-shaped metallic plate by means of slitting rolls, an elongating process for elongating the slit metallic plate by means of elongating rolls and a pressing process for pressing the elongated metallic plate by means of finishing rolls, the above described objects can be attained.

The apparatus of the present invention comprises a pair of slitting rolls for forming transversely extending slits in a band-shaped metallic plate at predetermined intervals in the longitudinal direction thereof, leaving at least one longitudinal extending unslit portion, a pair of elongating rolls for elongating the slit metallic plate in the longitudinal direction to form transversely extending slots from the slits, and a pair of finishing rolls for pressing the elongated metallic plate into a flat plate.

Each of the slitting rolls has a plurality of teeth which are formed in the outer peripheral surface thereof at predetermined intervals in the longitudinal direction of the outer peripheral surface so as to extend in the width direction of the slitting rolls, leaving at least one predetermined untoothed portion.

Each of the teeth is composed of a land formed in the top surface thereof, a cutting edge formed in one end of the land and a heel formed in the other end of the land and each of the teeth of the slitting roll which rotates in such a direction that the heel precedes the cutting edge, has such a shape that the cutting edge strikes against the band-shaped metallic plate in advance of the heel and that the angle which is formed by the cutting edge and the land ranges from 60 degrees to 90 degrees.

At least one of the elongating rolls has at least one projection which is formed in the outer peripheral surface thereof in the longitudinal direction of the outer peripheral surface so as to be opposed to the unslit portion and the finishing rolls have a smooth pressing surface, respectively.

DETAILED DESCRIPTION OF THE INVENTION

Hereinafter, the present invention will be explained in accordance with embodiments with reference to the drawings in detail.

As shown in FIG. 1, the producing process of the present invention is composed of a slitting process $P_1$ (first process) by means of slitting rolls 4*a* and 4*b*, an elongating process $P_2$ (second process) by means of elongating rolls 5*a* and 5*b* and a pressing process $P_3$ (third process) by means of finishing rolls 6*a* and 6*b*.

At first, in the first process, a band-shaped metallic thin plate 1 is fed between a pair of opposed slitting rolls 4*a* and 4*b* rotating in the opposite directions to form slits therein.

Figure 6:
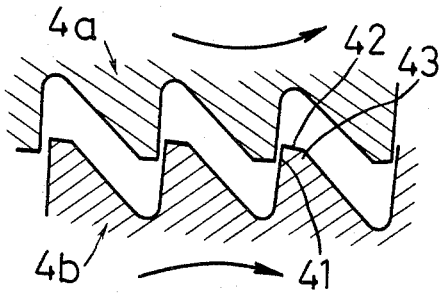
FIG. 6 is a sectional view of a main part of a slitting roll.
Figure 7:
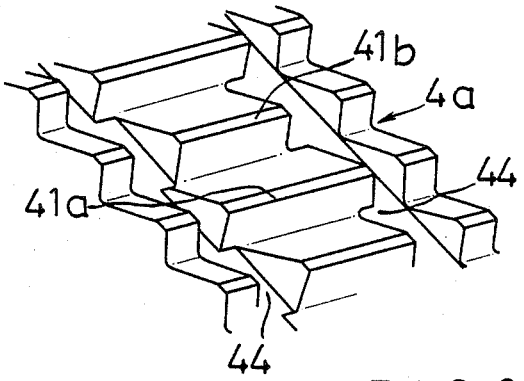
FIG. 7 is a perspective view of a main part of a slitting roll.

The slitting rolls 4*a* and 4*b* are provided with saw-shaped teeth, each of which is composed of a cutting edge 41, a land 42 and a heel 43, in the outer periphery thereof at predetermined pitches as shown in FIG. 6 and FIG. 7 respectively. And they are disposed so that the opposed cutting edges 41 thereof are engaged with each other through a predetermined clearance (6 to 7% of the thickness of the band-shaped metallic thin plate) enough to form slits. And it is good enough for the opposed cutting edges 41 to be engaged with each other by the depth nearly equal to the thickness of the band-shaped metallic thin plate. But, even if the slitting rolls 4*a* and 4*b* are not completely engaged with each other, the slits can be formed in the metallic thin plate, if they cut thereinto by about two third of the thickness thereof respectively.

The cutting edges 41 are formed along the outer periphery of the rolls 4*a* and 4*b* at predetermined intervals so as to extend in the width direction thereof.

On both sides of each cutting edge in the width direction of each roll, escape portions 44 are formed. These escape portions 44 are continued along the outer periphery of each roll.

In the central portion defined by the escape portions 44, long cutting edges 41*a* and slightly shorter cutting edges 41*b* are alternately arranged.

Both side end portions of the cutting edges 41 have an equal length to each other.

When the band-shaped metallic thin plate 1 is fed between the rotating slitting rolls 4*a* and 4*b*, long slits 11 and slightly shorter slits 12 are alternately formed in the longitudinal direction thereof at predetermined intervals. And on both sides of the slits 11 and 12, short side slits 13 having an equal length are formed in both side ends thereof.

As a result, between the slits 11 and 12 and the side slits 13, longitudinally extending connecting portions 14 are formed. The width of the connecting portions 14 is changed every other slit as indicated by $P_1'$ in FIG. 2.

Next, the band-shaped metallic thin plate 1 wherein slits are formed, is continuously fed between the rotating elongating rolls 5*a* and 5*b*.

Figure 8:
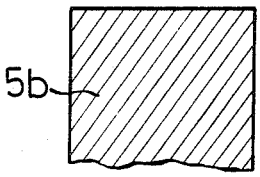
FIG. 8 and FIG. 9 are sectional views of main parts of elongating rolls.
Figure 9:
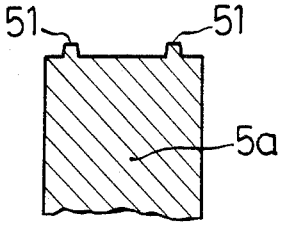

The peripheral surface of the elongating roll 5*b* is made smooth as shown in FIG. 8 and in the peripheral surface of the elongating roll 5*a*, two projecting portions 51 are formed therealong so as to be opposed to the connecting portions 14.

The connecting portions 14 of the band-shaped metallic thin plate 1 which passes between the elongating rolls 5*a* and 5*b* are rolled by the elongating roll 5*b* and the projecting portions 51 of the elongating roll 5*a*.

As a result, the metallic thin plate 1 is elongated as indicated by $P_2'$ in FIG. 2.

In the second process as described above, the slits 11 and 12 are enlarged into the longitudinal direction of the metallic thin plate 1 into long slots 15 and 16.

Then, the band-shaped metallic thin plate 1 wherein long slots 15 and 16 were alternately formed in the second process, is continuously fed between the finishing rolls 6*a* and 6*b* having a smooth peripheral surface respectively. The metallic thin plate 1 which was formed in the second process as indicated by $P_2'$ in FIG. 2 has a curved cross section as shown in FIG. 3, due to the partial rolling.

In the third process, the curved metallic thin plate 1 is pressed by the finishing rolls 6*a* and 6*b* to obtain a flat core member $P_3'$ for the trim as shown in FIG. 4.

The obtained core member is covered with a covering material such as rubber or synthetic resin and then a bending stress is applied to the covered core member in a direction perpendicular to the longitudinal direction thereof. The core member is broken in narrower portions of the connecting portions 14. Thus the trim wherein disconnected core pieces B having a long slot 16 respectively are embedded within the covering material A is obtained as shown in FIG. 5. This trim is further subjected to a bending work to be bent like a letter U in the width direction thereof.

In working the present invention, durability of the slitting rolls is an important factor.

Figure 10:
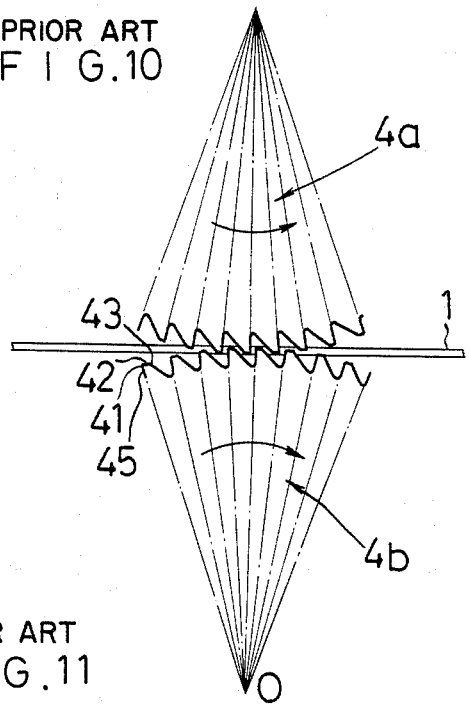
PRIOR ART F I G.10
FIG. 10 and FIG. 11 are views showing the teeth or one tooth of the conventional slitting roll.

As shown in FIG. 10, when the slitting rolls 4*a* and 4*b* are rotated in the directions of the arrows respectively, the heel 43 of the slitting roll 4*b* precedes the cutting edge 41 thereof while cutting edge 41 of the sitting roll 4*a* precedes the heel 43 thereof.

In the conventional slitting rolls, the shape of the teeth of each slitting roll is nearly the same, the angle $\theta$ formed by the cutting edge 41 and the land 42 of each tooth is about 90°, and the line 45 of the cutting edge 41 extends toward the center O of each slitting roll.

In the conventional slitting roll having the above described structure, the cutting edges 41 of the slitting roll 4*b*, which are preceded by the heel 43 are frequently broken.

Figure 11:
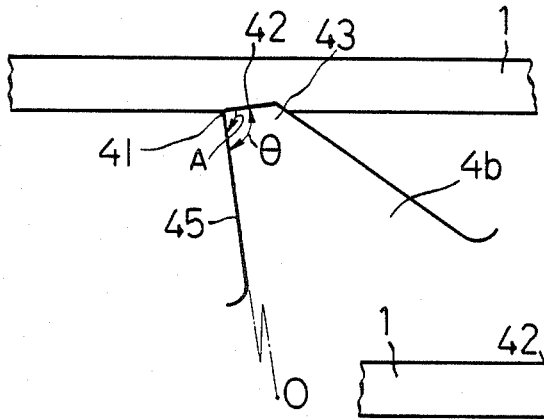
PRIOR ART F I G.11

We presumed that the breakage of the cutting edges 41 of the slitting roll 4*b* is caused by the fact that the heel 43 of the roll 4*b* is struck against the band-shaped metallic plate before the cutting edge 41 thereof to be pushed thereagainst so that a bending load is applied to the cutting edge 41 in the direction of the arrow A repeatedly as shown in FIG. 11.

Figure 12:
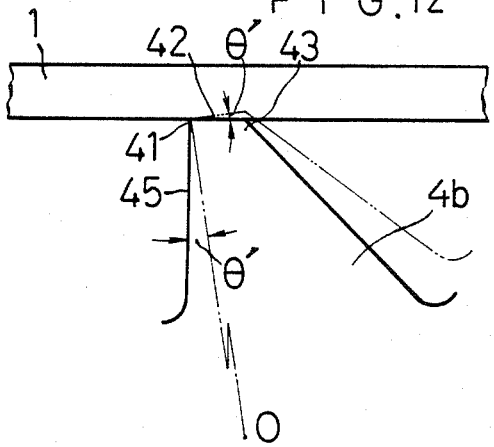
FIG. 12 is a view showing one tooth of the present invention.

FIG. 12 shows a slitting roll having excellent durability which is good to use in working the present invention. The tooth of FIG. 12 is designed so that the land 42 or the cutting edge 41 is struck against the band-shaped metallic plate before the heel 43 by inclining the line 45 of the cutting edge 41 and the land 43 in the direction opposite to the rotating direction of the roll by an angle $\theta'$ from the conventional slitting roll.

In the slitting roll having the above described teeth, such breakage of the cutting edges as observed in the conventional slitting roll does not occur.

The line 45 of the cutting edge 41 is not always required to be deviated from the center O of the slitting roll. When the line 45 is not deviated, the angle $\theta$ of the cutting edge 41 becomes smaller than the conventional one, this is about 90°.

In this case, the angle $\theta$ must be not less than 60°, in order to maintain enough strength of the cutting edge 41.

As described above, the present invention relates to a method and apparatus for producing a core member to be used within a trim, which has a large number of long slots extending in the width direction thereof at predetermined intervals in the longitudinal direction thereof by continuously feeding the band-shaped metallic thin plate through the slitting rolls, the elongating rolls and the finishing rolls.

Compared with the conventional punching method, according to the method of the present invention, scraps are not produced so that the waste of the material is decreased, the material cost can be decreased and the disposing process of the scraps can be omitted.

And the working speed can be improved largely into 100~150 m/min., compared with the conventional method.

Furthermore, the material is continuously worked by means of rolls so that any feeding means for the material of the core member is unnecessary in each of the producing processes, and that the long slots can be formed at accurate intervals.

In the above described embodiment of the present invention, a core member for a trim, wherein two kinds of long slots having different length in the width direction thereof are alternately arranged is produced. In addition, a core member for a trim having slots of the same length and connecting portions of the same width can be also produced by making the length of each cutting edge, equal to each other.

Having now fully described the invention, it will be apparent to one of ordinary skill in the art that many changes and modifications can be made thereto without departing from the spirit or scope of the invention as set forth herein.

What is claimed is:

1. An apparatus for continuously producing a core member to be embedded within a trim, comprising:

a pair of slitting rolls for forming transversely extending slits in a band-shaped metallic plate at predetermined intervals in the longitudinal direction thereof, leaving at least one longitudinal extending unslit portion;

each of said slitting rolls having a plurality of teeth which are formed in the outer peripheral surface thereof at predetermined intervals in the longitudinal direction of said outer peripheral surface so as to extend in the width direction of said slitting rolls, leaving at least one predetermined untoothed portion;

each of said teeth being comprised of a land formed in a top surface thereof, a cutting edge formed in one end of said land and a heel formed in the other end of said land; and one of said slitting rolls being positioned to rotate in such a direction that said heel on each of said teeth precedes said cutting edge and being shaped so that the cutting edge strikes against said band-shaped metallic plate in advance of said heel, the angle formed by said cutting edge and said land ranging from 60 degrees to 90 degrees and wherein said cutting edge deviates from the line connecting said cutting edge and the center of said slitting roll in a direction opposite to the rotating direction of said slitting roll;

a pair of elongating rolls for elongating said slit metallic plate in the longitudinal direction to form transversely extending slots from said slits;

at least one of said elongating rolls having at least one projection which is formed in the outer peripheral surface thereof in the longitudinal direction of said outer peripheral surface so as to be opposed to said unslit portion; and a pair of finishing rolls for pressing said elongated metallic plate into a flat plate;

said finishing rolls having a smooth pressing surface, respectively.

2. An apparatus for continuously producing a core member, according to claim 1, wherein;

each of said teeth is formed in the width direction of said outer peripheral surface of each of said slitting rolls, leaving untoothed portions in both side ends of said outer peripheral surface of each of said slitting rolls.

3. An apparatus for continuously producing a core member, according to claim 2, wherein:

said teeth are composed of two kinds of teeth having a different length from each other; and said two kinds of teeth are formed alternately in the longitudinal direction of said outer peripheral surface of each of said slitting rolls.

4. An apparatus for continuously producing a core member, according to claim 1, wherein:

each of said teeth is formed in the width direction of said outer peripheral surface of each of said slitting rolls discontinuously, leaving two untoothed portions; and said two untoothed portions extend in the longitudinal direction of said outer peripheral surface of each of said slitting rolls.

5. An apparatus for continuously producing a core member, according to claim 4, wherein:

a portion of each slitting roll is defined by two untoothed portions, having two kinds of length; and wherein short, central portions and long, central portions of said teeth are arranged alternately in the longitudinal direction of said outer peripheral surface of each of said slitting rolls thereby defining the respective lengths of said untoothed portions.

* * * * *